US006145298A

United States Patent [19]

Burton, Jr.

[11] Patent Number: 6,145,298

[45] Date of Patent: Nov. 14, 2000

[54] ATMOSPHERIC FUELED ION ENGINE

[75] Inventor: Kenneth E. Burton, Jr., Paris, Tex.

[73] Assignee: Sky Station International, Inc., Washington, D.C.

[21] Appl. No.: 08/851,751

[22] Filed: May 6, 1997

[51] Int. Cl.[7] ..... F03H 1/00

[52] U.S. Cl. ..... 60/202; 313/359.1

[58] Field of Search ..... 60/202; 313/359.1, 313/362.1

[56] References Cited

U.S. PATENT DOCUMENTS

| | | | |
|---|---|---|---|
| 2,765,975 | 10/1956 | Lindenblad . | |
| 2,809,314 | 10/1957 | Herb | 313/63 |
| 2,949,550 | 8/1960 | Brown . | |
| 3,018,394 | 1/1962 | Brown . | |
| 3,022,430 | 2/1962 | Brown . | |
| 3,071,705 | 1/1963 | Coleman et al. . | |
| 3,119,233 | 1/1964 | Wattendorf et al. . | |
| 3,120,363 | 2/1964 | Hagen . | |
| 3,130,945 | 4/1964 | De Seversky . | |
| 3,638,058 | 1/1972 | Fritzius | 313/63 |
| 4,011,719 | 3/1977 | Banks . | |
| 4,126,806 | 11/1978 | Kapetanakos et al. | 313/155 |
| 4,783,595 | 11/1988 | Seidl . | |
| 4,825,646 | 5/1989 | Challoner . | |
| 5,465,023 | 11/1995 | Garner . | |

FOREIGN PATENT DOCUMENTS

| | | | |
|---|---|---|---|
| 2-9952 | 1/1990 | Japan | 60/202 |

OTHER PUBLICATIONS

Hans Fantel "Major de Seversky's Ion Propelled Aircraft," *Popular Mechanics,* Aug., 1964.

V.A. Zykov "*A Unipolar Ion–Flow Tandem Motor Operating in the Atmosphere With Injection Starting*" Plenum Publishing Corporation Jan. 1976.

*Primary Examiner*—Louis J. Casaregola

*Attorney, Agent, or Firm*—Breneman & Georges

[57] ABSTRACT

An environmentally compatible propulsion system for low maintenance and long term durations at high altitudes is provided which is capable of utilizing high altitude ambient gas as fuel and producing ozone as a by-product of propulsion. The ion engine propulsion system ionizes a portion of an ambient atmospheric fuel to create a negative ionic plasma for bombarding and accelerating the remaining portion of the ambient atmospheric gas in a focused and directed path to an ion thruster anode. The novel ion engines provided create a negative ionic plasma between a cathode ion thruster and a ring-shaped anode in a housing composed of an electrical insulative material in which the cathode ion thruster is charged to −18 to −110 kilovolts (kv) to utilize ambient atmospheric gas as the propellant.

72 Claims, 15 Drawing Sheets

(2 of 15 Drawing Sheet(s) Filed in Color)

FIG. 8
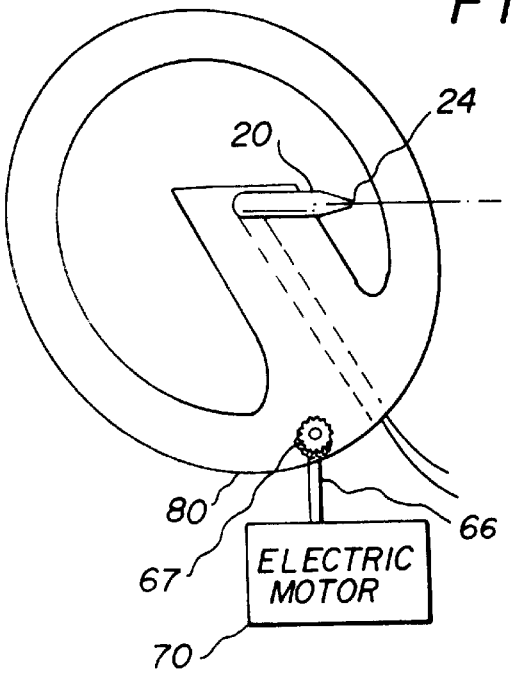
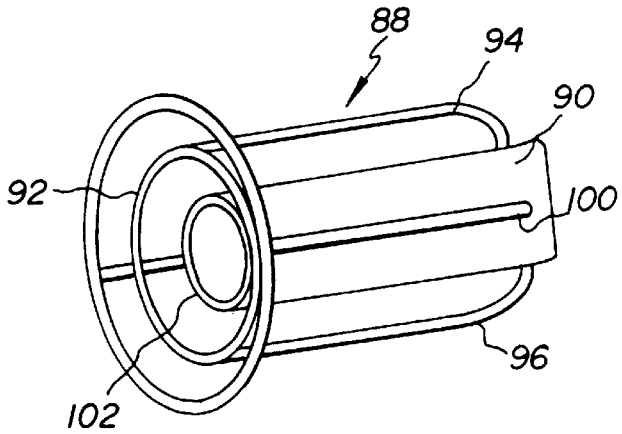
FIG. 9
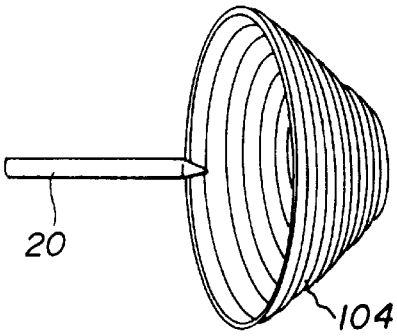
FIG. 10
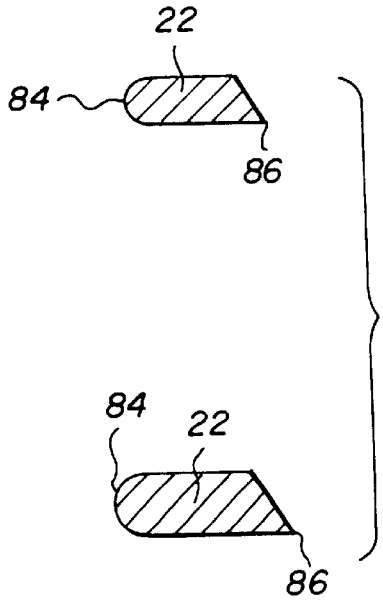
FIG. 12

COLOR PICTURE NO. 1

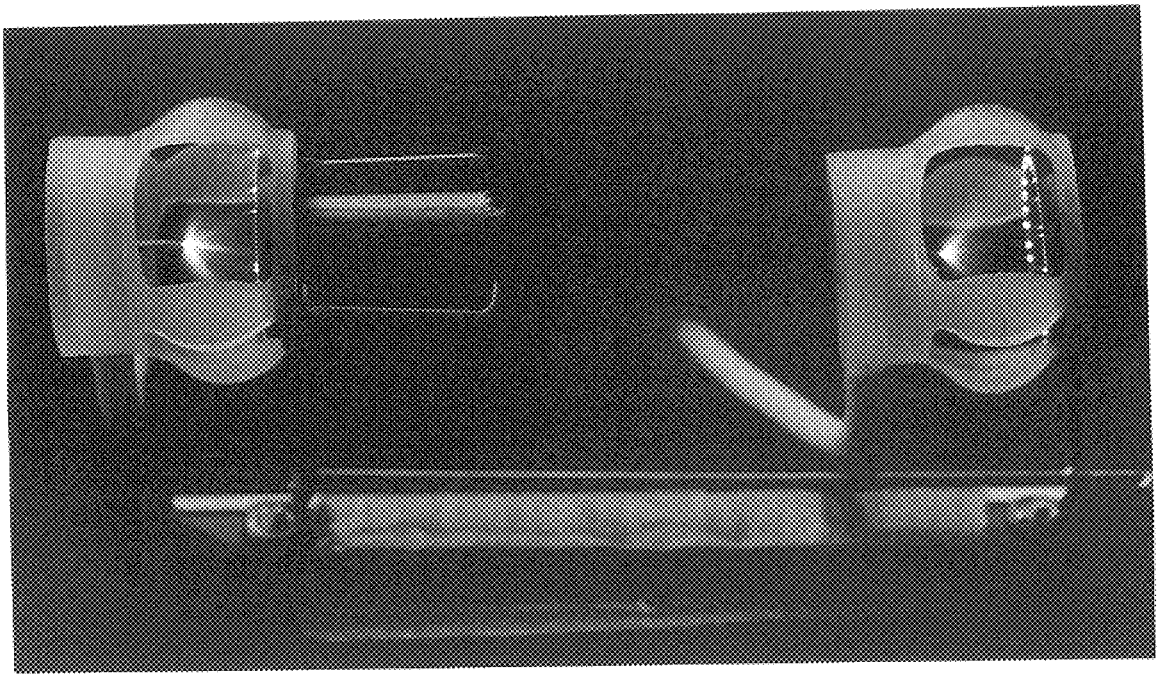
COLOR PICTURE NO. 2 FIG. 21

ATMOSPHERIC FUELED ION ENGINE

BACKGROUND OF THE INVENTION

1. Field Of The Invention

The invention relates to propulsion systems for accelerating charged particles to generate propulsive force particularly adapted for use at high altitudes. More particularly the invention pertains to an ion engine having a cathode ion thruster or emitter for ionizing an ambient atmospheric gas in combination with an electrically insulative housing and a ring-shaped anode in which ions are accelerated and propelled through the ion engine to generate thrust from an ambient atmospheric gas. As used herein the term ambient atmospheric gas refers to an ionizable gas present in the troposphere, stratosphere and ionosphere that serves as fuel in the novel ion engine.

The novel ion engine is designed to run continuously at high altitudes and without maintenance for years without any fuel other than ambient atmospheric gas and a power source which preferably includes at least one renewable component such as solar energy. The novel ion engine not only does not pollute the earth's atmosphere but is designed to produce ozone in stratospheric operations to assist in repairing the hole in the ozone layer of the earth's upper atmosphere. The novel ion engine is designed to produce low thrust and operate at low velocities which as used herein means a thrust sufficient to maintain an airship in a geostationary position in the stratosphere.

The novel ion engine ionizes only a portion of the ambient atmospheric gas which ions are accelerated through an electric field from the cathode to the anode at which point ions bombard and collide with the remaining portion of ambient atmospheric gas to create propulsion during the lifetime of the ions existing between the cathode and anode. The cathode is charged to a potential of from about −18 to −110 kilovolts (kv) and possibly less in high altitude applications.

The novel ion engine may include accessory components such as tapered nacelles, compressors or other components for increasing the density of ambient atmospheric gas supplied to the novel ion engine and optionally include pre-ionizers, multiple stages and other means for increasing the ionization of the ambient atmospheric gas before it is introduced into the novel ion engine. The novel ion engine is designed for operation at stratospheric heights such as for example to maintain a geostationary position for a platform used for telecommunications applications, and provide propulsion in atmospheric conditions at high altitudes which means altitudes in the stratosphere 7 miles to 30 miles (11 to 31 kilometers (km)) and ionosphere 30 miles to 300 miles (11–500 km) above the earth's surface.

2. Description Of Related Prior Art

The prior art has long investigated propulsion systems which have few moving parts and utilize abundant natural resources as fuel while being environmentally safe. This is particularly true in high atmosphere and space exploration where engines must be reliable since defects and failure of moving parts make repair or replacement difficult and expensive. Furthermore high altitude and space applications provide limited natural resources for use as fuel.

The prior art has investigated various forms of rocket engines and ion engines for high altitude and space applications. These rocket engines and ion engines of the prior art use principles of ionization but do so in a different way than the present invention. Such prior art engines generally operate at high temperatures and attempt to either burn or ionize the highest possible percentage of the propellant since the propellant fuel must be carried with the airborne or space borne vehicle and cannot be wasted. Further such ion engines require high levels of power and utilize such exotic types of propellants as Argon, Cesium, Mercury, Xenon and others. The ion engine of the invention differs from such engines by not attempting to ionize all the available propellant and in not having to carry propellant in the attendant vehicle since the ion engine of the invention utilizes ambient atmospheric gas as the propellant.

The prior art has also proposed various forms of electrostatic, ion and corona-type devices for propulsion. The devices have employed various forms of grids, rings, wires and plates for the anode or the cathode which have required large amounts of electrical power and have produced large amounts of pollution by-products. Except for applications in outer space such devices are for the most part not practical due to their size, weight and power requirements. Such devices furthermore have not sought to focus or direct ionization on a selected portion of the air upon which they have sought to utilize as fuel for propulsion. The prior art devices also have not focused on the types of collisions of particles, their spacial relationship and the nature of the collisions that occur that are necessary for propulsion or the form of plasma that exists between the electrodes during the brief period the ions exist in the plasma before they are destroyed. The novel ion engine in contrast to the prior art utilizes a particular relationship between the cathode and anode as well as the formation of a particular type of plasma and the collisions that occur in that plasma to provide propulsion.

The novel ion engine of the invention is designed for use in the upper atmosphere to provide low velocity and low thrust to maintain a geostationary position for platforms used for telecommunications. Such applications require low maintenance, possible continuous operation, a renewable energy source and an abundant source of fuel or propellant. These requirements are provided by the novel ion engine which utilizes ambient atmospheric gas as a propellant, can utilize solar cells as a renewable power source and has virtually no moving parts that could wear out or require expensive repair or maintenance. The novel engine of the invention not only can meet these objectives but it is also environmentally compatible by producing ozone which is needed to repair the hole in the ozone layer and protect the earth from environmental damage.

The most relevant known patented prior art is Coleman, et al. U.S. Pat. No. 3,071,705 which creates propulsion by an "electric wind" resulting from the application of a high voltage positive charge to an anode having a toroid connected to an ionization head. In FIG. 3 toroid ionization head anode is placed in axial alignment with a cathode target having a metal ring connected to a target with the flow of air and corona discharge moving from the anode to the cathode.

The ion engines constructed in accordance with the invention are different in design and function from the Coleman, et al. '705 prior art engine. In contrast to Coleman, et al. '705 the novel ion engine has the flow of air and corona discharge move the opposite direction, namely from the cathode to the anode. In addition the novel engine does not employ a ring and toroid combination but instead a tapered cylindrical cathode ion thruster and a ring-shaped anode. The large cylinder and toroid anode electrode of Coleman, et al. '705 with a plurality of needle points 19 is different than the single sharply tapered or needle pointed cathode of the novel ion engine of the invention. This difference in design and construction not only results in differences in the shape and focus of flow patterns but also differences in the constituents of the "electric wind" or plasma created and its propulsive effect upon the other constituents of the electric wind and their collisions with neutral gas molecules.

Lindenblad U.S. Pat. No. 2,765,975 discloses an ionic wind generating duct to provide propulsion by employing a series of ion producing ion brooms connected to a high voltage source of either polarity. The ion brooms are disposed in a pipe or duct with alternating conductive and insulating sleeves which terminate in positive and negative voltage sources. The novel ion engine of the invention does not employ ion brooms but instead a focused and directed beam of ionic plasma directed from a cathode ion thruster directly at a ring-shaped anode.

More recent prior art pertaining to the construction and design of ion engines has been directed toward providing more efficient and exotic grids and screens to serve as electrodes or the utilization of more exotic forms of ion fuel than air. Examples of more recent prior art ion engines include Seidl U.S. Pat. No. 4,783,595 and Challoner, et al. U.S. Pat. No. 4,825,646 which proposes the use of the inert gas Xenon instead of prior art Mercury as a propellant for ion engines. Such exotic ion engines which have employed Cesium, Mercury and other exotic propellants have generally been employed in applications in outer space applications due to their cost and complexity. Recent prior art pertaining to grid and screen construction includes Garner U.S. Pat. No. 5,465,063 which pertains to a woven carbon fiber in a matrix of carbon and Banks U.S. Pat. No. 4,011,719 which pertains to a woven mesh screen of stainless steel wire cloth sputter coated with tantalum which serves as an anode for ion thrusters. These ion engines and ion engine components are different than the present novel ion engine since they do not use ambient atmospheric gaseous fuel.

The novel ion engine in contrast to the prior art utilizes a cylindrical finely tapered cathode ion thruster and a ring-shaped anode along with means for adjusting the distance between the cathode ion thruster and the ring-shaped anode. The novel ion engine in contrast to the prior art is non-polluting and produces ozone which at stratospheric levels should help alleviate past damage to the ozone layer due to fluorocarbon damage. The novel ion engine unlike the prior art ionizes a selected portion of the ambient atmospheric gas and controls the nature and types of collisions between the ions propelled from the ion thruster and the remaining portion of the ambient gas during the short duration of the life of the ion between the cathode ion thruster and the anode to provide thrust. The novel engines of the invention utilize these principles alone or together with pre-ionizers, multi-staged engines, compressors and other systems for increasing either the density of the ambient atmospheric gas or the efficiency of the process of ionization.

SUMMARY OF THE INVENTION

The formation of ions or a corona in an ion engine is only a first step since the creation of either ions or a corona does not create propulsive thrust. Propulsive thrust not only requires the creation of ions but also a specific type of plasma in which the collisions are controlled during the lifetime of the ions so that they can be focused and directed so that a momentum exchange is possible. This can be accomplished by utilizing a cathode ion thruster of a cylindrical configuration tapering to a fine point in combination with a smooth and preferably rounded ring-shaped anode strategically disposed from the cathode thruster.

The cathode ion thruster or emitter and anode receiver must also be connected to a high voltage power source and an ambient atmospheric gas must be available as a fuel. A portion of the ambient atmospheric gas fuel is believed to be converted to a type of plasma which predominately contains negative ions that will be referred to as negative ionic plasma which bombards and accelerates the remaining portion of the ambient atmospheric gas in a focused and directed path to the anode. This focused acceleration of negative ionic plasma from a preferably tapered or pointed cylindrical ion emitting cathode thruster collides with the remaining ambient atmospheric gas to create propulsion.

Ion engines constructed in accordance with the invention include a housing, a cylindrical cathode which preferably is tapered to a fine point, an anode of a substantially circular or ring-shaped configuration having one or more concentric rings, a voltage power source having a negative potential connected to the cathode and a positive power source connected to the anode. The cathode ion thruster is constructed of a metallic conductive material and in the best mode is constructed of brass, aluminum and magnesium. The anode is also of a metallic conductive material and in the best mode is also constructed of brass, aluminum and magnesium. The cathode and anode may be constructed of the same or different metallic conductive materials. The engine housing is constructed of an electrically non-conductive substance such as plastic or nylon and in the preferred embodiment is a Delrin nylon which is a type of nylon resistant to high voltage breakdown.

The cylindrical cathode ion thruster and substantially ring-shaped anode are disposed in axial alignment in the housing which includes an ambient atmospheric gas inlet and outlet. The cylindrical cathode and substantially ring-shaped anode are preferably axially adjustable with respect to each other so that their distance may be adjusted in response to the density of the atmospheric gas, voltage and other variables involved in the propulsive output of the novel engine. An electromechanical arrangement is provided for the precise adjustment of the distance between the cathode ion thruster and the anode.

The novel ion engine preferably includes an electrically non-conductive nacelle for connecting the engine to an airship. The engine housing and nacelle or both may include compressors or other means of increasing the density of the ambient atmospheric gas introduced into the inlet before ionization by the cathode ion thruster. The novel engine may also include pre-ionizers, multiple engine consecutive stages and other such means for increasing the ion efficiency and hence thrust or propulsion of novel ion engines constructed in accordance with the invention.

The electrical power and voltage requirements for varying propulsion or thrust of the novel engine may be supplied from a variety of electrical power means such as fuel cells, batteries, solar cells or other electrical power sources and combinations thereof and other such electrical power means as are known to those skilled in the art. In the preferred embodiment of the invention the electrical power means should have the ability to supply negative voltage in the range of about −18 to −110 kilovolts (kv) and may be higher as the mean free path or space between collisions with another particle change. The propulsion system of the invention preferably also include means for renewing electrical power such as solar cells to provide for a long term operation of the novel ion engine which utilizes ambient atmospheric gas as its fuel.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

The objects and advantages of the invention will become apparent to those skilled in the art from the following detailed description of the preferred embodiments when read in conjunction with the accompanying drawings in which:

FIG. 8 is a perspective view of the alternative embodiment of the cathode support bezel illustrated in FIG. 7;

FIG. 9 is a perspective view of an alternative embodiment of an anode assembly constructed in accordance with the invention;

FIG. 10 is a perspective view of a cathode ion thruster and a multiple nested anode ring arrangement in accordance with the preferred embodiment of the invention;

FIG. 12 is a side view taken along the line 12—12 of FIG. 5;

FIG. 21 (color picture no. 2) is a pre-ionization or multi-stage embodiment of the novel engine in operation.

DESCRIPTION OF THE PREFERRED EMBODIMENTS

Figure 1:
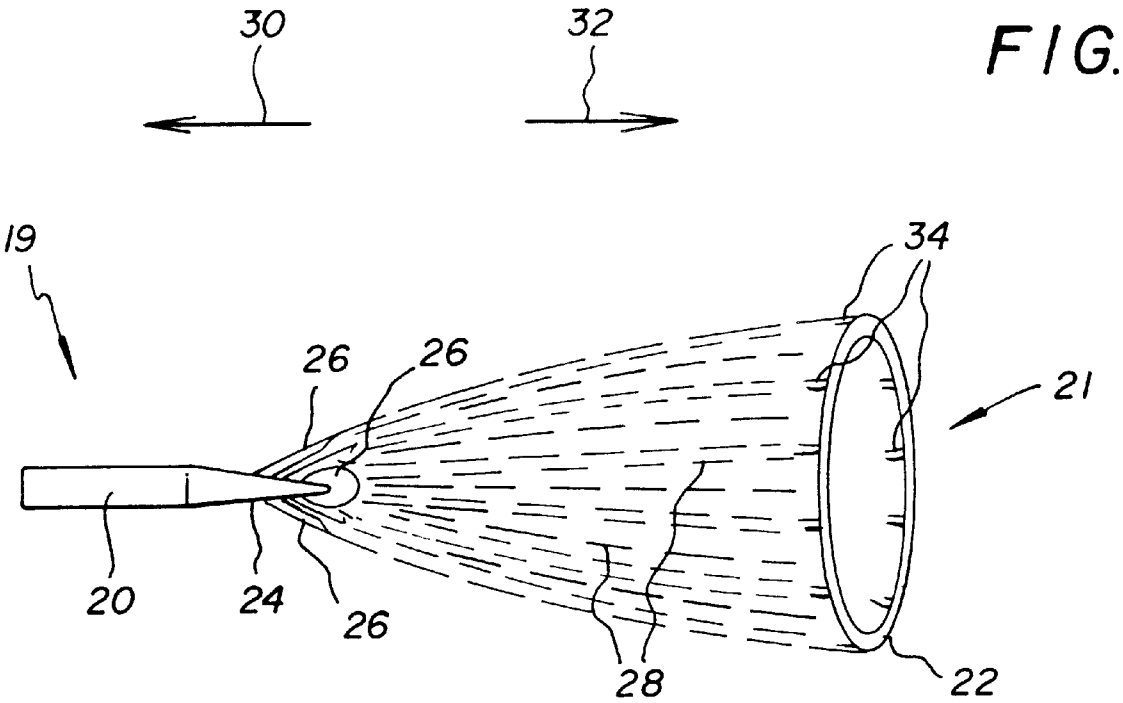
FIG. 1 is a schematic view of a corona discharge from a tapered cylindrical electrode and the ion path between the tapered cylindrical electrode and a ring-shaped electrode.

The novel ion engine is a result of an extensive research investigation into the creation, life span and mechanics of ion actions required to produce thrust. This investigation involved detailed study on the design of cathode ion thrusters, anodes and the more recent investigation of the negative ion plasma created in the operation of the novel ion engine to produce thrust. The formation of ions is only the beginning step necessary to create propulsion since the type of ions created and the events occurring during the life of the ions are critical to the amount of propulsion and the by-products produced by the propulsion.

Ions in the novel ion engine are created by direct field emission of electrons from the cathode ion thruster. Once created the ions are accelerated through an electric field from the region of the cathode ion thruster in the direction of the anode. If there were no collisions throughout the lifetime of an ion, then the total momentum of the particle as expressed in Equation 1 would be canceled when the ion hit the anode and the same negligible momentum would be returned to the engine in the opposite direction. Therefore no net force or propulsion would be experienced from the engine.

Equation 1

$$p = \sqrt{2em_{ion}V_{Applied}}$$

where $p$ = momentum $V_{applied}$ = voltage applied $e$ = basic charge of an electron $m_{ion}$ = mass of ion If however the ions undergo collisions with ambient atmosphere the engine is able to develop thrust. The origin of this net thrust can be seen by examining the momentum exchange during the lifetime of an ion.

The first step in the process occurs when electrons are emitted via direct field emission from the cathode. This event imparts a small amount of momentum to the novel ion engine as expressed in Equation 2.

Equation 2

$$p_{em} = m_e V_{thermal}$$

where $p_{em}$ = momentum from emission $m_e$ = mass of electron $V_{thermal}$ = thermal velocity Once the electron is free it will travel an average of one mean free path before it encounters a neutral molecule, this imparts a momentum as expressed in Equation 3 on the engine via the field interaction and conservation of momentum.

Equation 3

$$p_{el^*} = C_c\sqrt{\frac{2m_e V_{App} l^* e}{D}}$$

where $p_{el^*}$ = momentum transfer of one electron neutral collision $C_c$ = arbitrary constant denoting the elasticity or prevent momentum transfer of a collision $m_e$ = mass of electron $V_{app}$ = Voltage applied $l^*$ = mean free path $e$ = basic charge of an electron $D$ = roughly anode cathode separation in cm Depending on the attachment probability $p_{Aci}$ the number of collisions that do not produce an ion is expressed in Equation 4.

Equation 4

$$N_{NA} = \frac{1}{p_{Aci}}$$

where $N_{NA}$ = number of collisions without attachment $p_{Aci}$ = attachment probability Assuming completely elastic collisions or collisions in which all momentum is transferred to another molecule which then assumes $C_C$=1 leaves us with a total momentum gain expressed in Equation 5 before attachment takes place.

Equation 5

$$P_{NA} = N_{NA} p_{el^*}$$

where $P_{NA}$ = total momentum transfer before attachment $N_{NA}$ = number of collisions without attachment $p_{el^*}$ = momentum transfer of one electron neutral collision Once an ion has been created the ion is accelerated through l* before it encounters another neutral molecule. When it does a collision occurs imparting a momentum expressed in Equation 6 to the engine through field interaction and conservation of momentum once again.

Equation 6

$$p_{in} = C_c\sqrt{\frac{2m_i V_{App} l^* e}{D}}$$

-continued where $p_{in}$ = momentum for one ion neutral collision $C_{ce}$ = arbitrary constant denoting the elasticity or prevent momentum transfer of a collision $m_i$ = mass of an ion $V_{Applied}$ = voltage applied $l^*$ = mean free path $e$ = basic charge of an electron $D$ = roughly anode cathode separation in cm This process will be repeated $N_C$-$N_{NA}$ times where $N_C$ is the total number of steps between anode and cathode and is expressed in Equation 7.

Equation 7

$$N_C = \frac{D}{l^*}$$

where $D$ = roughly anode cathode separation in cm $l^*$ = mean free path

Once again assuming $C_C$=1 the total momentum gain by the engine from this process is expressed in Equation 8.

Equation 8

$$P_{in} = (N_C - N_{NA})p_{in}$$

where $p_{in}$ = momentum for one ion neutral collision $N_C$ = $N_C$ is the total number of steps between anode and cathode $N_{NA}$ = number of collisions without attachment $P_{in}$ = total momentum from ion-neutral collisions This brings us to the final event which is the impact of the ion on the anode surface which imparts momentum to the engine in the reverse direction as expressed in Equation 9.

Equation 9

$$p_{ia} = -\sqrt{\frac{2m_i V_{App} l^* e}{D}}$$

where $p_{ia}$ = total momentum from ion-anode collisions $m_i$ = mass of an ion $V_{Applied}$ = Voltage applied $l^*$ = mean free path $e$ = basic charge of an electron $D$ = roughly anode cathode separation in cm Giving us an overall momentum gain per ion as expressed in Equation 10.

Equation 10

$$P_{Tot} = p_{em} + P_{NA} + P_{in} + p_{in}$$

where $P_{Tot}$ = total momentum transfer per electron $p_{em}$ = momentum from emission $P_{NA}$ = total momentum transfer before attachment $P_{in}$ = total momentum from ion-neutral collisions $p_{in}$ = momentum for one ion neutral collision or since $p_{em}$ and $P_{NA}$ are small and assuming $N_C$ is large then the result is expressed in Equation 11.

Equation 11

$$P_{Tot} \approx P_{in} = N_c P_{in} = \sqrt{\frac{2m_i V_{App} eD}{l^*}}$$

where $P_{Tot}$ = total momentum transfer per electron $P_{in}$ = total momentum from ion-nuetral collisions $N_C$ = $N_C$ is the total number of steps between anode and cathode $m_i$ = mass of an ion $V_{applied}$ = voltage applied $e$ = basic charge of an electron $l^*$ = mean free path $D$ = roughly anode cathode separation in cm Which, in the case of no electron current, that is the case where all drawn current is carried by ions, gives us the total force exerted by the engine as expressed in Equation 12.

Equation 12

$$F_{Tot} = \frac{I}{e} P_{Tot} = \sqrt{\frac{2I^2 m_i V_{App} D}{el^*}}$$

where $I$ = *current*

From the foregoing it is apparent to those skilled in the art that successful operation of an ion engine requires a successful management of the following tasks. First since the engine cannot function at all without free ions in the acceleration stage the engine must have a scheme for ionizing ambient air. Second the engine must have a scheme for accelerating the ions it has created. Third there must be a scheme for insuring collisions occur before the ions reach the anode where they are annihilated.

The design of the novel ion engine covered the three tasks by providing means for increasing the number of collisions that an ion undergoes before reaching the anode, means for shaping the accelerating field to focus and direct ion path flow without the creation of narrow paths which might create "streamers" or paths that allow for electron flow without collisions and means for increasing the ion current in the engine.

In the propulsion art the term 'thruster' is normally used to describe an entire engine as opposed to an engine subcomponent such as an anode or a cathode. In the electronics art the term 'ion thruster' has sometimes been used to describe simply an anode or a cathode subcomponent. As will be used herein and as will be understood by those skilled in the art, the word 'cathode' or 'cathode ion thruster' or 'cathode thruster' refers to the same cathode subcomponent element of an engine. Similarly, the word 'anode' or 'anode ion thruster' or 'anode thruster' as used herein refers to the same element, namely the anode element of an engine.

Referring now to FIG. 1 an electrode or an ion thruster 19 is illustrated together with an electrode ring 21. In the preferred embodiment of the invention ion thruster 19 is a cathode ion thruster 20 of a substantially cylindrical cross-section which tapers to a tapered tip 24 and the electrode ring 21 is an anode electrode ring 22. The connection of ion thruster to a voltage source of from about −18 to −110 kv produces a corona 26 which surrounds the end of the tapered tip 24 which together with electrode ring 22 and the ions created from a portion of an ambient atmospheric gas colliding with the remaining portion of the ambient atmospheric gas creates a negative ionic plasma 28. The flow of the negative ionic plasma provides propulsion in the direction of mechanical motion arrow 30 which is substantially equal and opposite to the direction of the ion emission direction represented by arrow 32.

Figure 2:
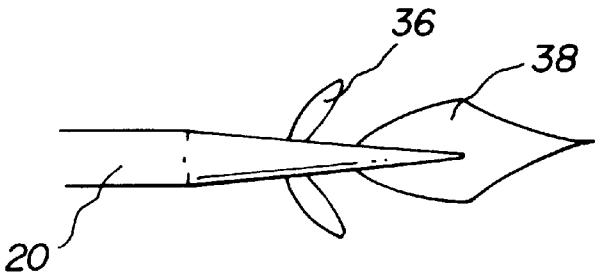
FIG. 2 is a schematic view similar to FIG. 1 illustrating the effect tapering has upon the corona and ion path with the same ring-shaped electrode (not shown)

A secondary corona 34 is provided on electrode ring 22 which represents the destruction of most of the ions as ozone is created and expelled from the novel ion engine in the direction of arrow 32. The degree of taper is a balance between thrust efficiency and the ability of the ion thruster to handle input power without arcing. The degree of tapering of tapered tip 24 also has an effect on not only thrust efficiency but also on the efficiency of ion production. A thin cathode ion thruster with a long tapered point as illustrated in FIG. 2 produces thrust more efficiently and can produce two or more regions of ionization 36, 38 and have beneficial effects on the shape of the resulting acceleration field. Cathodes however with approximately a 40 degree taper allow a greater amount of input power before arcing.

Figure 3:
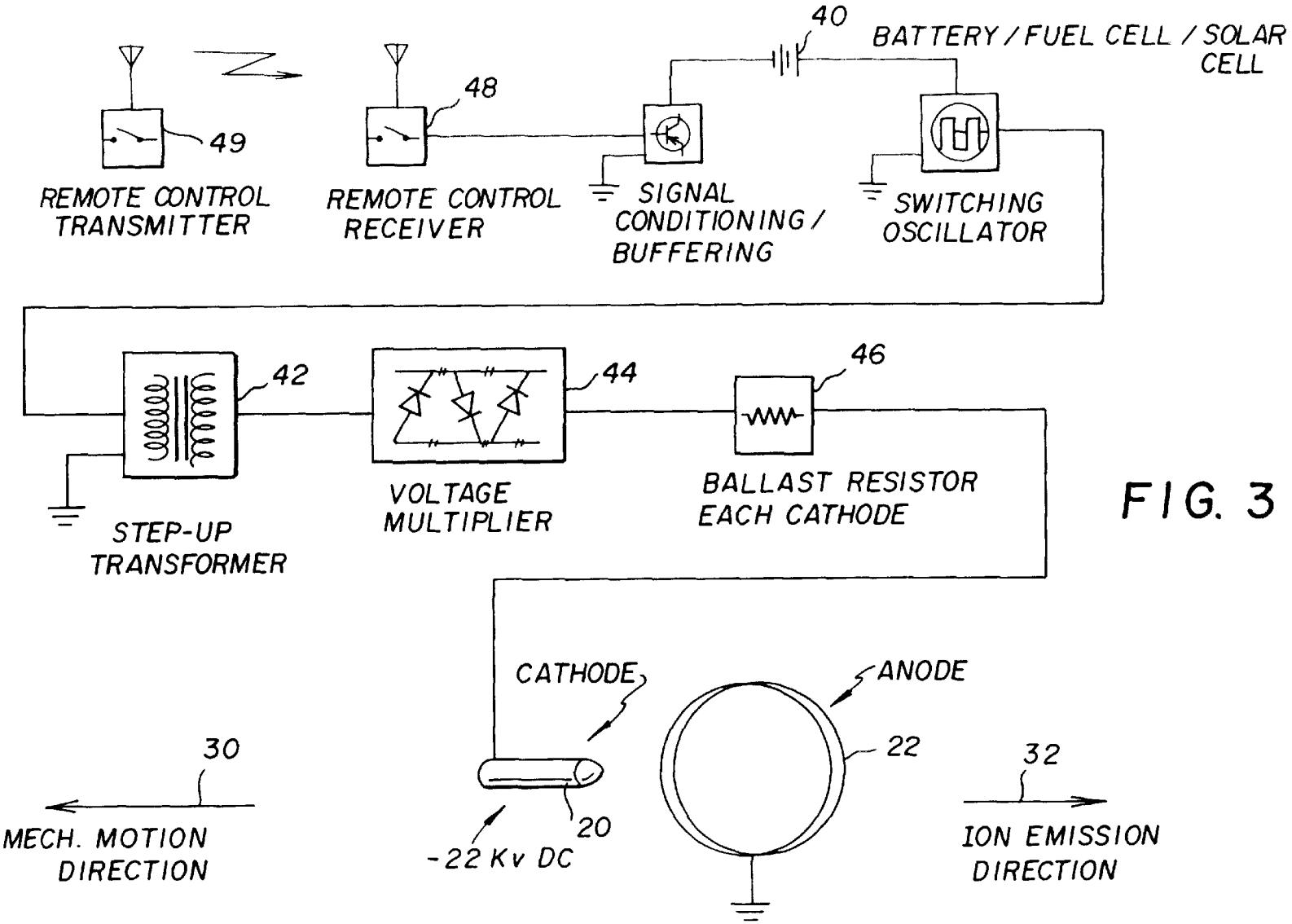
FIG. 3 is a schematic view of the electrical circuit for operating an ion engine having a cylindrical cathode and a ring-shaped anode in accordance with the preferred embodiment of the invention.
Figure 16:
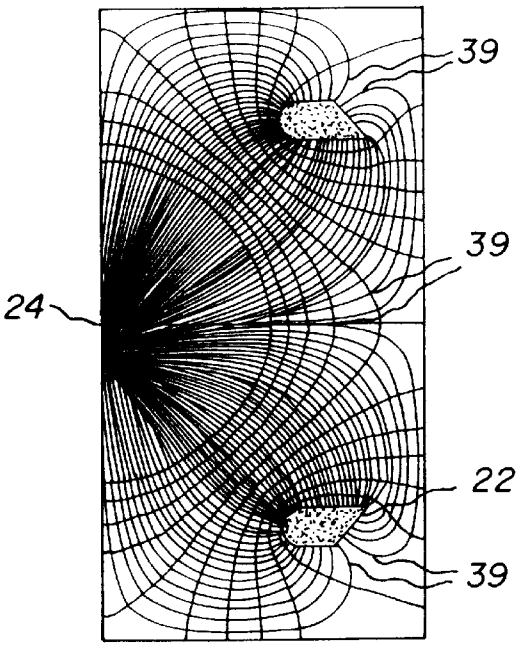
FIG. 16 is a diagram of an ionization field plot of an ion engine constructed in accordance with the invention employing an anode ring of a cross-sectional configuration as illustrated in FIG. 12.

Referring now to FIGS. 1, 3 and 16 a novel ion engine is illustrated in which ion thruster 20 in its preferred application is of a solid cylindrical configuration and is tapered to a tapered tip 24. The tapering of ion thruster 20 services to direct E forces as represented by lines 37 in FIG. 16 axially toward electrode ring 22 which in the illustration is an anode electrode ring. The reduction of radially extending potential lines 39 increases the strength of the thrust or propulsion as represented by momentum reaction arrow 30.

The nature and by-products of propulsion are further dependent upon the nature of the voltage charges on ion thruster 19 and electrode ring 21 since the nature of the charge effects the nature and constituents of the electric wind and the plasma created and its effect upon propulsion. As illustrated in FIG. 3 the ion thruster 19 is cylindrical in cross-section and is a cathode ion thruster 20 and the electrode ring 21 is an anode electrode ring 22 in which preferably a −22 or greater kilovolt (kv) charge is applied to the cathode ion thruster 20 to result in the creation of a specific type of electric wind having negatively charged particles and a plasma that is different from the conventional type of plasma created by typical prior art ion engines.

Plasma in the prior art generally refers to a charged constituent having approximately equal amounts of positive and negative ions in the electric wind. The constituents of the focused and directed plasma created by the novel ion engine is unlike the prior art plasmas. The type of plasma produced by the novel ion engine is a negative ionic plasma having different constituents. Consequently engines constructed in accordance with the invention employ a cylindrical tapered cathode in combination with a ring-shaped anode having one or more concentric rings connected to a power source 40 (FIG. 3) which may be a number of conventional sources such as fuel cells, batteries, solar cells alone or in combination. Anode electrode ring 22 may be of a solid configuration and may have one or more concentric rings in a staggered configuration as illustrated in FIG. 9.

Figure 13:
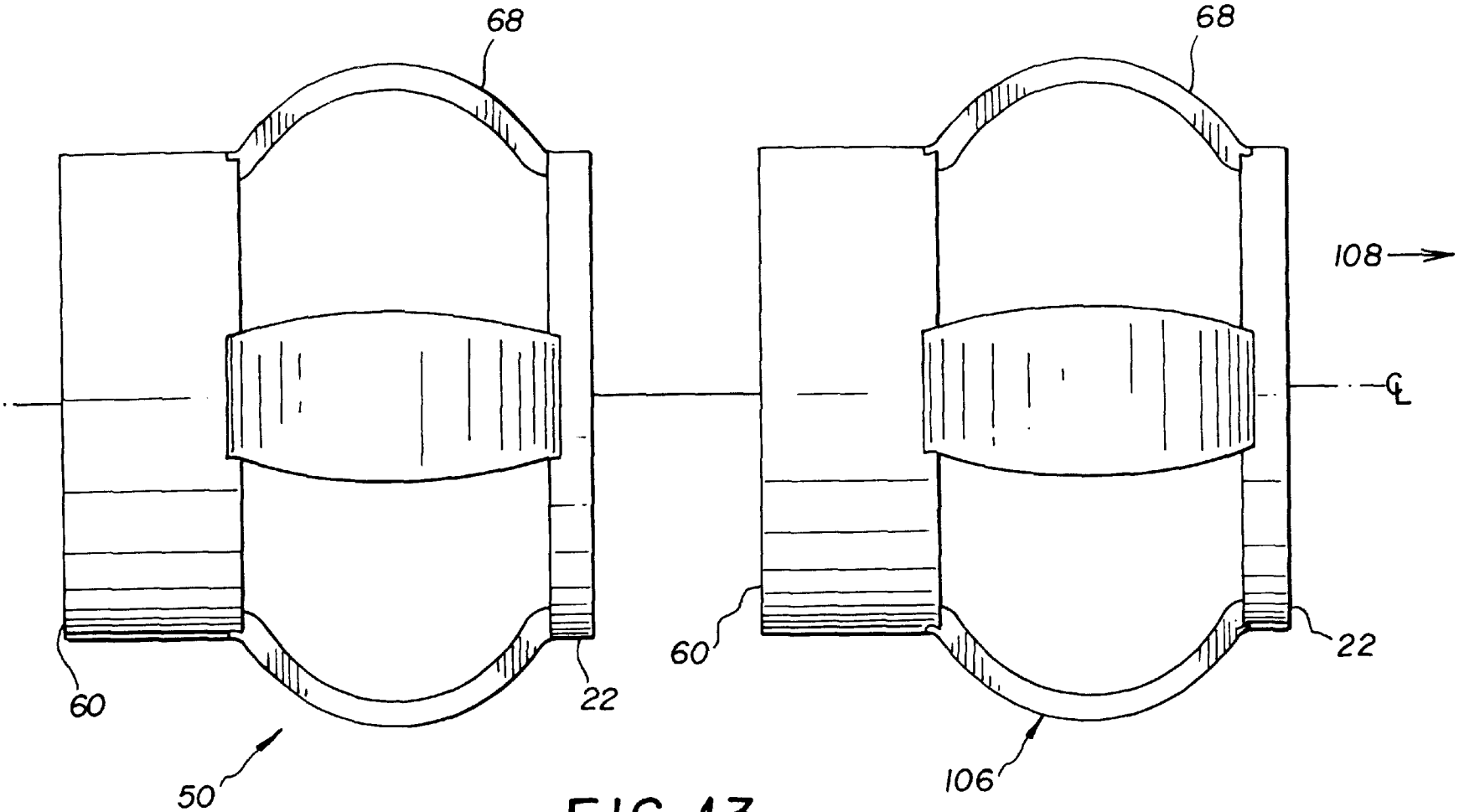
FIG. 13 is a side elevational view of a multiple stage embodiment using two novel ion engines of the invention in series.

The preferred circuitry for operating novel ion engines in accordance with the invention includes a step up transformer 42, a voltage multiplier 44 and an optional ballast resistor 46 for each cathode ion thruster. This is particularly applicable where a pre-ionizer cathode or where a multiple stage or two-stage novel ion engine is utilized as illustrated in FIG. 13 and which will be discussed hereinafter in greater detail.

An optional remote control receiver 48 in combination with a remote control transmitter 49 may be provided to activate the novel ion engine from the ground. This is particularly advantageous where the novel ion engines are remotely controlled on unmanned airships disposed in the stratosphere as will be described hereinafter in greater detail with regard to FIG. 19.

Referring now to FIGS. 4, 5, 6, 7 and 11, 12 and 16 an ion engine 50 constructed in accordance with a preferred embodiment is illustrated in which cylindrical shaped cathode ion thruster 20 having a tapered tip 24 is charged to a voltage of from about −20 to −110 kilovolts to produce an ion emission in the direction of arrow 32 (FIG. 3) and impart a mechanical motion in the direction of arrow 30. The novel ion engine 50 includes a nacelle 52 which is preferably constructed of a non-conductive material having an inlet 54 and an outlet 56. Since the novel ion engine uses ambient atmospheric air as fuel it is not intended to operate in outer space. The novel ion engine is designed to utilize ambient atmospheric gas as a fuel. As a result the outer engine housing or nacelle 52 is preferably designed to have a configuration in which the inlet 54 is larger than the outlet 56 to utilize the advantages of the pressure effect on gases. Alternatively or additionally compressors and pre-ionizers can be utilized to increase the pressure of the ambient atmospheric gas supplied to the engine or increase the ionization efficiency as a means of increasing the thrust of the novel ion engine.

Figure 4:
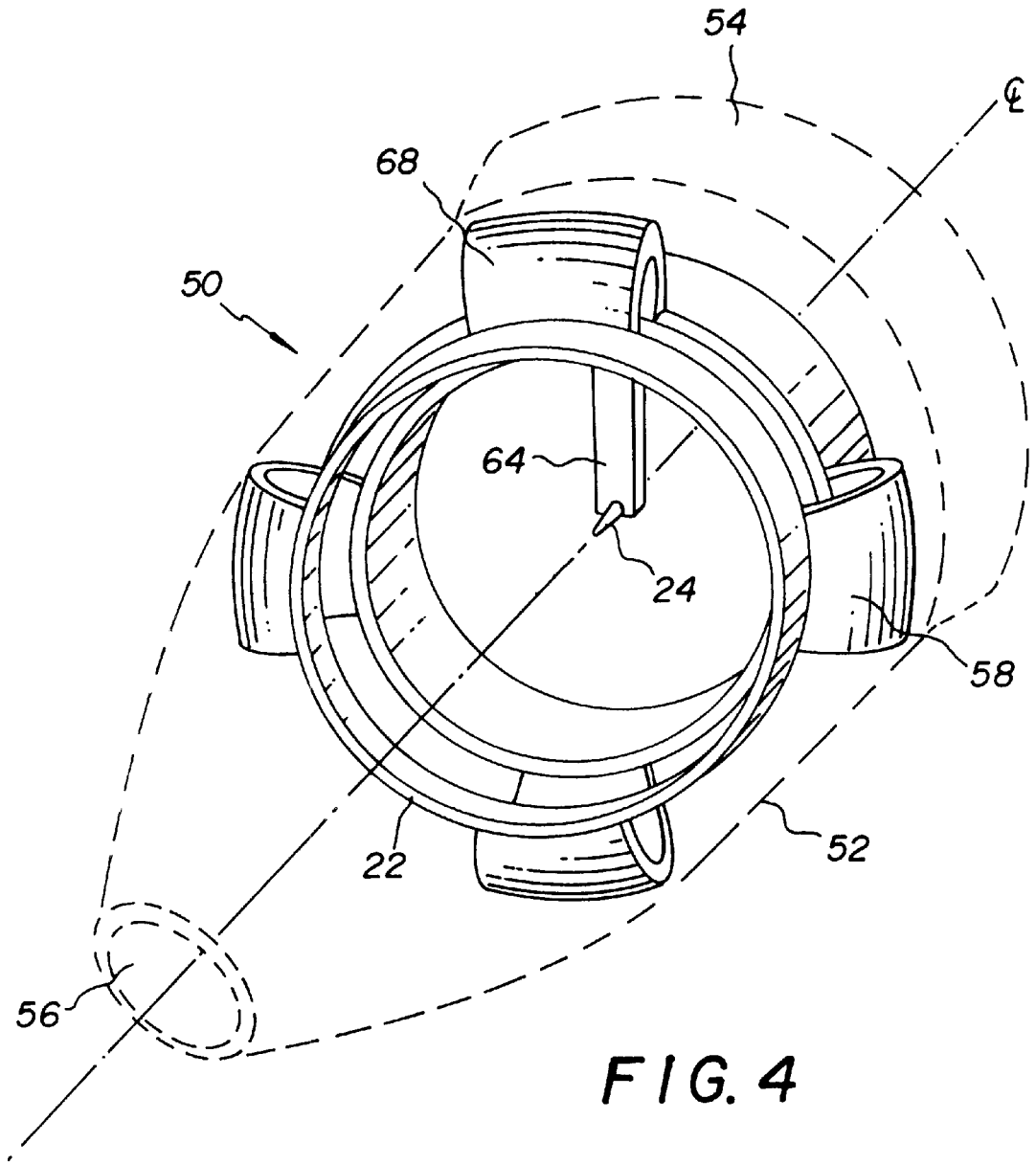
FIG. 4 is a perspective view of an ion engine constructed in accordance with the invention.
Figure 5:
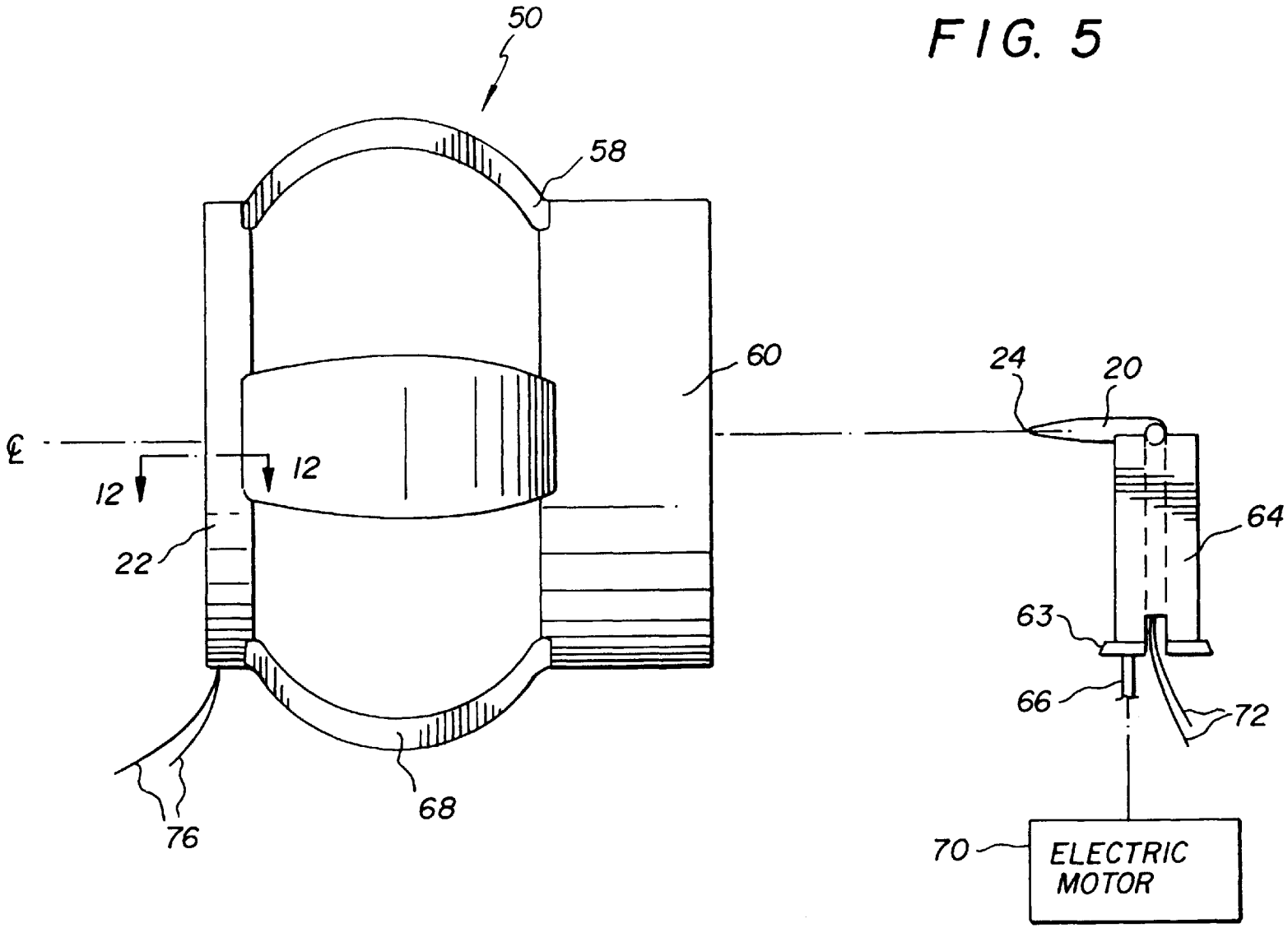
FIG. 5 is an exploded side elevational view of the novel ion engine of FIG. 4.
Figure 6:
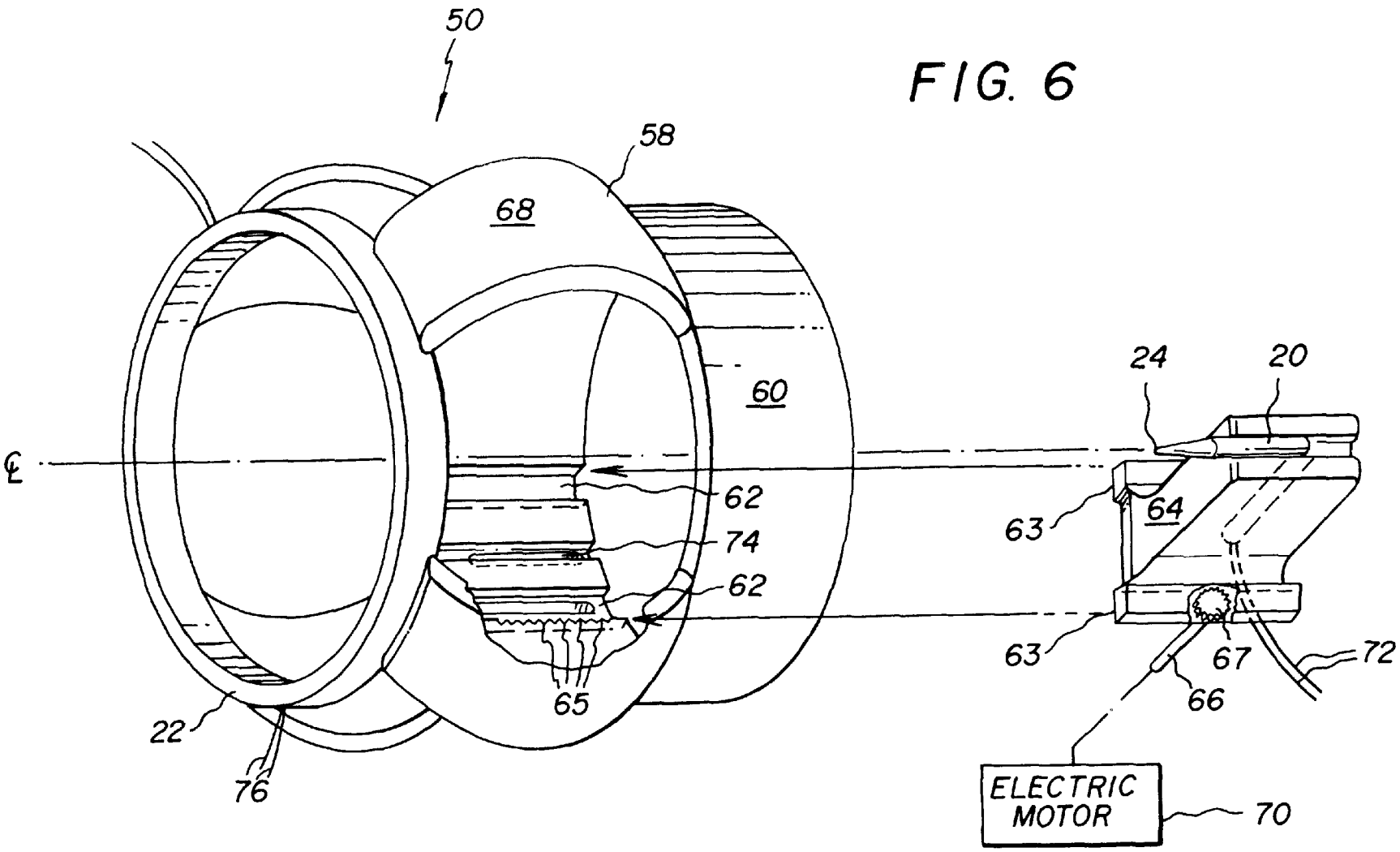
FIG. 6 is an exploded perspective view of the novel ion engine of FIG. 5.
Figure 7:
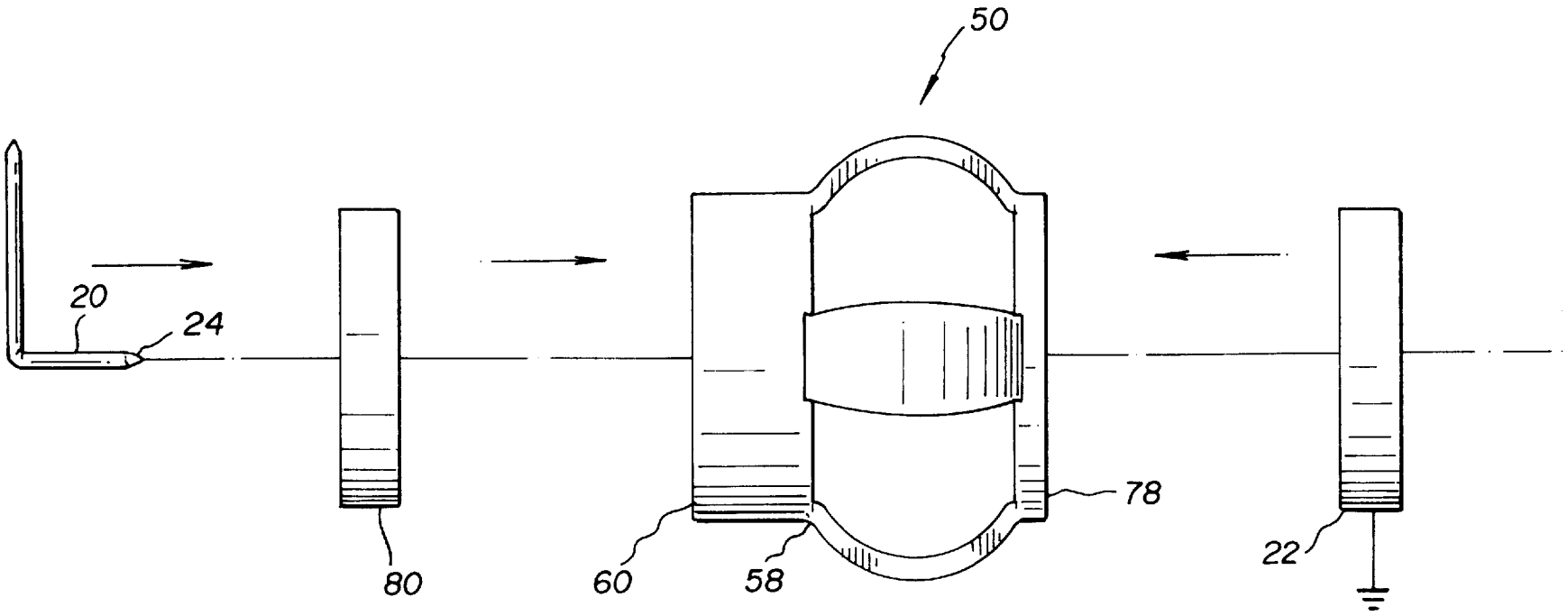
FIG. 7 is an exploded side elevational view of an alternative embodiment of an ion engine constructed in accordance with the invention.

The center of inlet 54 is in axial alignment with the center of the narrower outlet 56 which is also in axial alignment with the center line of the tapered tip 24 of the cathode ion thruster 20 which is in axial alignment with the anode electrode ring 22. The rotational alignment of the novel ion engine in nacelle 52 is not critical to its operation and function so that cathode ion thruster 20 can be disposed downwardly with respect to the top of nacelle 52 as illustrated in FIG. 4 or from the bottom or sides of the internal engine housing 58 in relation to nacelle 52.

The preferred construction of cathode ion thruster 20 is either a tapered brass or aluminum rod which may be solid or a hollow tube which tapers to a closed tapered tip 24. Ion thruster 20 may also be constructed of any other metallic or conductive material. Anode electrode ring 22 is preferably also constructed of aluminum or brass but may also be constructed of any other metallic or conductive material. The internal engine housing 58 is constructed of an insulative material such as a non-conductive plastic, nylon or other durable non-conductive material. In the preferred embodiment of the invention internal engine housing is constructed of nylon and sold under the Trademark Delrin.

Referring now to FIGS. 5, 6, 7, 11 and 12 the housing 58 is constructed of a single piece of nylon having an annular inlet 60 at one end and an electrically non-conductive adjustable supporting means for supporting ion thruster 20 in an adjustable axial distance from electrode ring 22. In one embodiment a pair of grooved shaped racks 62 are provided for engaging corresponding keys 63 on cathode supporting assembly 64. One of the grooved shaped racks may include teeth 65 for adjustable cooperation with a pinion gear 66 having corresponding teeth 67. Cathode supporting assembly 64 in cooperation with rack 62 and corresponding keys 63 and gear 66 adjusts the axial position or distance between cathode supporting assembly 64 and ion thruster 20 with respect to anode electrode ring 22.

As will be recognized by those skilled in the art the electromechanical means for adjusting the axial distance between the cathode ion thruster and the electrode ring can be reversed. For example teeth 65 in one of the racks 62 can be placed on one or both keys 63 on cathode supporting assembly 64. Gear 66 with corresponding teeth 67 can be disposed in one of the racks 62 in inlet 60 to provide electromechanical means for adjusting the axial distance between the cathode ion thruster and the electrode ring. In either application of the invention gear 66 as well as the other electromechanical means provided should be constructed of an electrical insulative plastic or nylon material.

Anode electrode ring 22 is held in position in engine housing 58 by two or more prong-shaped projections 68 in internal engine housing 58. Cathode supporting assembly 64 and internal engine housing are both constructed of an electrically non-conductive plastic nylon or other durable material and preferably are both constructed of nylon and sold under the Trademark Delrin.

The distance between cathode supporting assembly 64 and hence tapered tip 24 of ion thruster 20 is fixed by the operation of pinion gear 66 which preferably is connected to an electrical control motor 70 illustrated schematically. Cathode supporting assembly 64 for ion thruster 20 includes wire leads 72 for connection to the power supply as illustrated in FIG. 3. Wire leads 72 may be threaded through a slot 74 in inlet 60 to provide for the unimpeded adjustment of cathode supporting assembly 64. Wire leads 72 are connected to the negative voltage source as indicated in FIG. 3 and wire leads 76 from ring 22 are connected to the positive voltage source.

The internal engine housing 58 and cathode supporting assembly may be constructed in a variety of different embodiments. In accordance with the best mode the internal engine housing includes a circular outlet 78 (FIG. 7) constructed of the same insulative nylon material as the rest of housing 58. The circular outlet terminates in a flange (not shown) which restrains anode electrode ring 22 in housing 58. In addition the cathode ring supporting assembly may be varied to provide a one piece circular bezel cathode supporting assembly 80 (FIG. 8). Bezel cathode assembly provides for a secure and precise mounting of the cathode assembly in inlet 60 of housing 58. The entire circular bezeled cathode assembly is made out of an insulative material and preferably is also constructed of the same electrically non-conductive nylon material as housing 58. Axial adjustment of bezeled cathode support assembly may be provided by an electrical control motor 70 with a pinion gear in a similar manner as heretofore discussed.

The preferred shape of the engine housing is somewhat frustro parabolic or frustro paraboloid so as not to impede the flow of ions and negative ionic plasma during operation.

Figure 11:
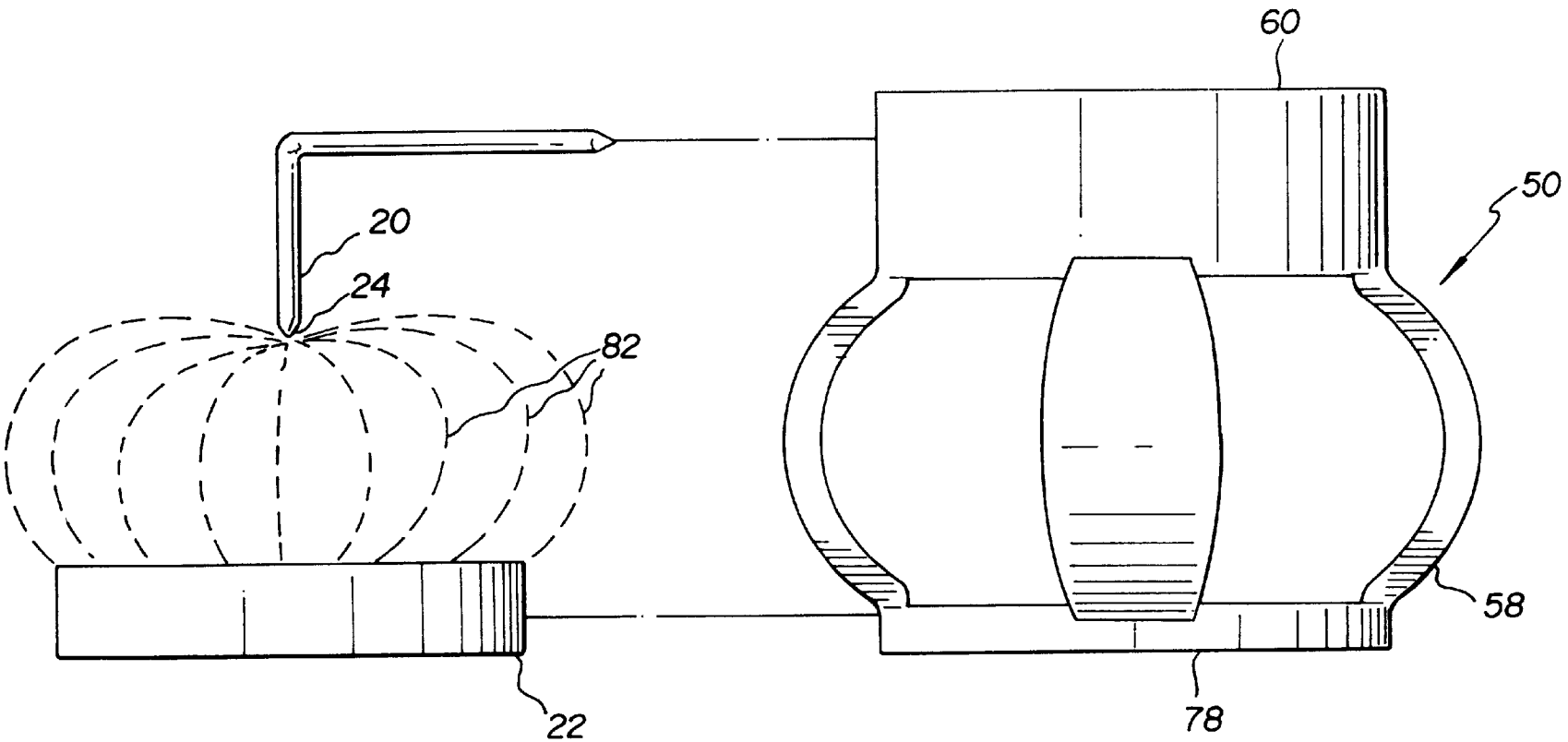
FIG. 11 is a side elevational exploded diagrammatic view of the ion path between the cathode ion thruster and an anode in the novel ion engine.

Referring now to FIG. 11 and color PICTURE NO. 1 the flow of ions and negative ionic plasma from the cathode ion thruster 20 to the electrode ring 22 is illustrated. The generally parabolic flow of particles 82 has been accommodated in the shape of internal engine housing 58.

Figure 15:
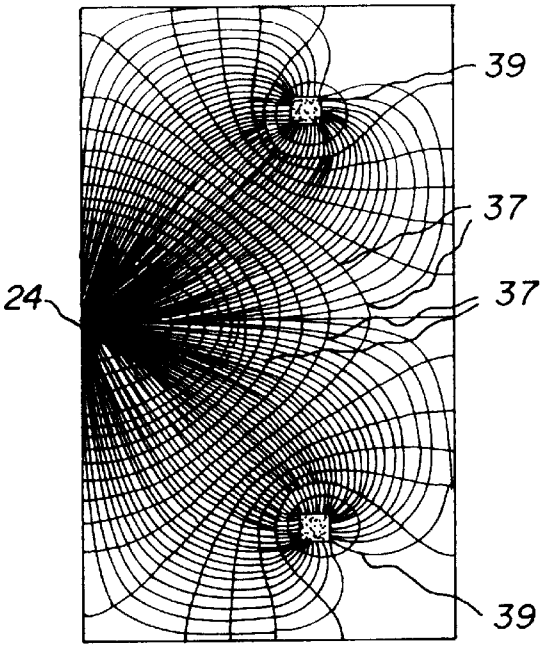
FIG. 15 is a diagram of an ionization field plot of an ion engine constructed in accordance with the invention employing an anode ring of a rectangular cross-sectional configuration.

The shape of the anode electrode ring also affects the thrust performance of the novel ion engine. Rings having a rectangular cross-section operate but are not preferred since sharp corners and edges on the leading edge of the circular anode ring can result in regions of excessive electron flow due to minor field variations as illustrated in FIG. 15. Anode electrode rings with rounded leading edges 84 (FIGS. 5, 12, 16) of anode ring 22 reduces the extending potential lines 39 and increases the strength of the propulsion or thrust. The tapering of the trailing edge 86 of anode electrode ring also appears to have a beneficial effect on reducing potential lines 39. When electron flow becomes great enough to ionize a path from the anode to cathode a low resistance path is formed and the engine arcs over with all the current traveling though a narrow path. Arc over is the worst failure mode of an engine since not only is no thrust produced but a strong spike is sent along the parts of the power bus and a large EM pulse emitted which is potentially damaging to the engine hardware.

Figure 17:
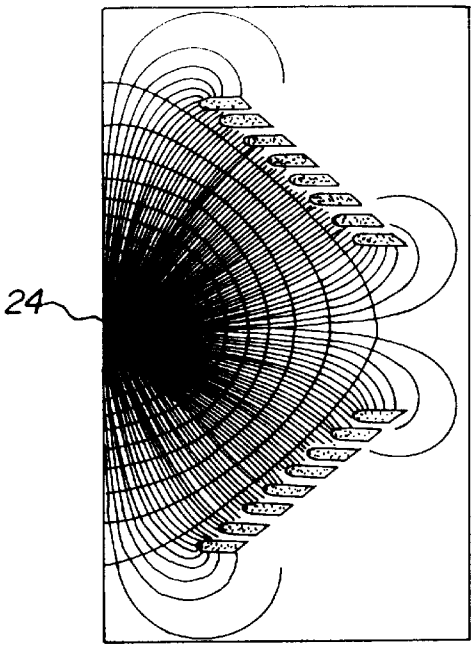
FIG. 17 is a diagram of an ionization field plot of an ion engine constructed in accordance with the invention employing an anode ring of a cross-sectional configuration of FIG. 10.

In accordance with the best mode of the invention multiple circular anodes having rounded leading edges are employed to increase thrust of the novel ion engine. Referring now to FIGS. 9, 10 and 17 multiple ring anode 88 having a recessed inner tubular body 90 which is circumscribed by a larger middle ring 92 is held in place by a pair of conductive pins 94 and 96. Circumscribing middle ring 92 is outer ring 98 which faces and is closest to cathode ion thruster 20. Outer ring 98 is similarly held in place by a pair of conductive pins 100, 102 connected to tubular body 90. The multiple ring anode 88 is also shown in operation in PICTURE NO. 2. The multiple ring anode embodiments as shown in FIGS. 9 and 10 have electrically conductive pins supporting the rings. This arrangement of rings in the ion thruster anode further reduces the E force lines as illustrated in FIG. 17. The multiple nested ring-shaped anode 104 appears to direct E forces axially toward the multiple nested ring-shaped anode to result in increased thrust as depicted in FIG. 17.

The operation of the novel ion engine as illustrated in FIGS. 4, 5, 6, 7, 11 and PICTURE NO. 1 produces a distinctive E field and discharge as illustrated in FIG. 16 and PICTURE NO. 1. In operation ion thruster 20 is charged to a potential in excess of −40 kv and the ion thruster 20 is placed approximately 3 cm (centimeters) from any part of the anode ring. The high field strength due to the sharp tip ejects electrons which produce the negative ions from a portion of the ambient atmospheric gas which collide with the remaining portion of ambient atmospheric gas to produce propulsion and ozone the by-product of propulsion. The focused and directed negative ionic plasma is believed to contain different types of particles which bombard and accelerate any remaining portion of ambient atmospheric gas in a focused and directed path to the anode.

Figure 18:
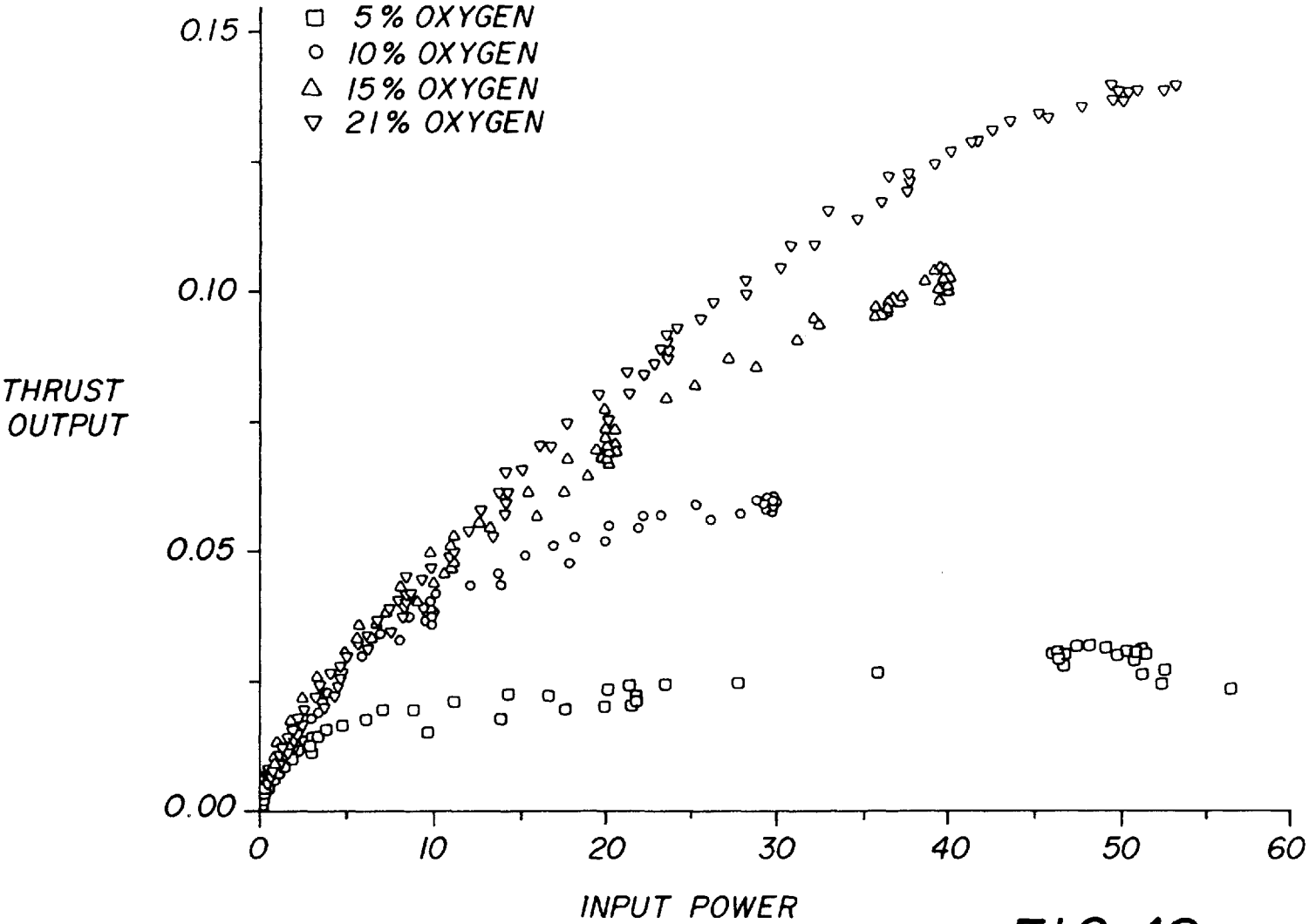
FIG. 18 is a graph illustrating thrust output based upon input power as a function of oxygen content in ambient atmospheric gas.

The formation of a distinctive negative ionic plasma is supported by FIG. 18 which depicts thrust at in ambient atmospheric gases with varying oxygen content. FIG. 18 also demonstrates that virtually no thrust is generated when the oxygen content of the ambient atmospheric gas drops below 5%. As oxygen content increases the thrust output of the engine increases as well as the ozone by-product of propulsion. FIG. 18 demonstrates the novel ion engine is safe to the upper atmospheric environment by producing ozone and not producing thrust based on the utilization of nitrogenous gases from the ambient atmospheric gas fuel.

The propulsion advantages of the novel ion engine can be further increased by the utilization of pre-ionizers or multi-stage novel ion engine arrangements. Referring now to FIG. 13 and PICTURE NO. 2 a multi-stage embodiment is illustrated in which novel ion engine 50 is the pre-ionizer or first stage for a second novel ion engine 106 with thrust being developed and increased along the center line in the direction of arrow 108 (FIG. 13). The novel ion engine is more efficient when air is blown through the engine than in still air. As a result the use of compressors and the utilization of multiple engines in series is beneficial. Experiments have shown the total thrust out of two engines in series exceeds that of two engines mounted in parallel.

The utilization of multiple stages increases the force or thrust of the engine by decreasing the mean free path of the system by increasing air pressure. This air pressure can be increased by utilizing compressors, utilizing flow pressure increasing nacelles and ion engine housings and utilizing the novel ion engine in series as heretofore explained with respect to FIG. 13.

Figure 14:
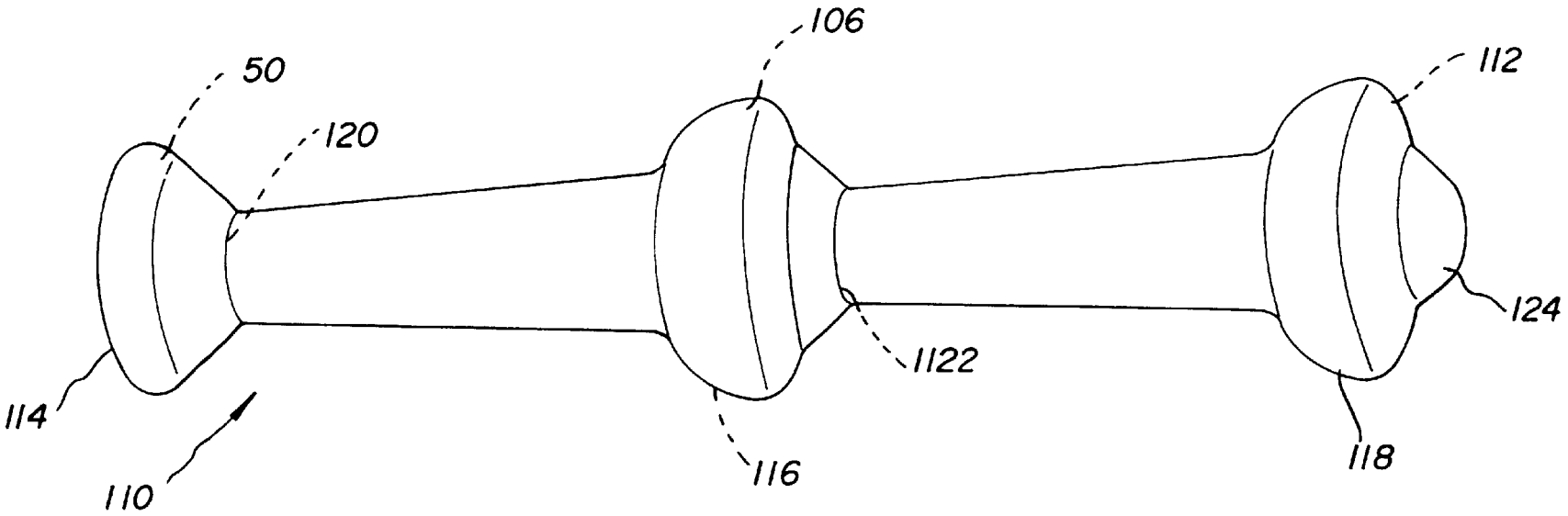
FIG. 14 is a perspective view of an alternative embodiment of an engine housing for a multiple stage embodiment utilizing multiple novel ion engines of the invention.

A further example of an aerodynamic multi-stage engine housing 110 is illustrated in FIG. 14 having three novel ion engines 50, 104 and 112 in serial axial alignment for the purpose of increasing thrust by the geometry of the intakes 114, 116, and 118 and the more constrictive outlets 120, 122 and 124. The geometry of the engine housing in combination with the serial axial alignment allows ion engine 50 to not only produce thrust but also operate as a compressor for ion engine 106 and for ion engine 106 to produce additional thrust and also function as a compressor for ion engine 112.

Figure 19:
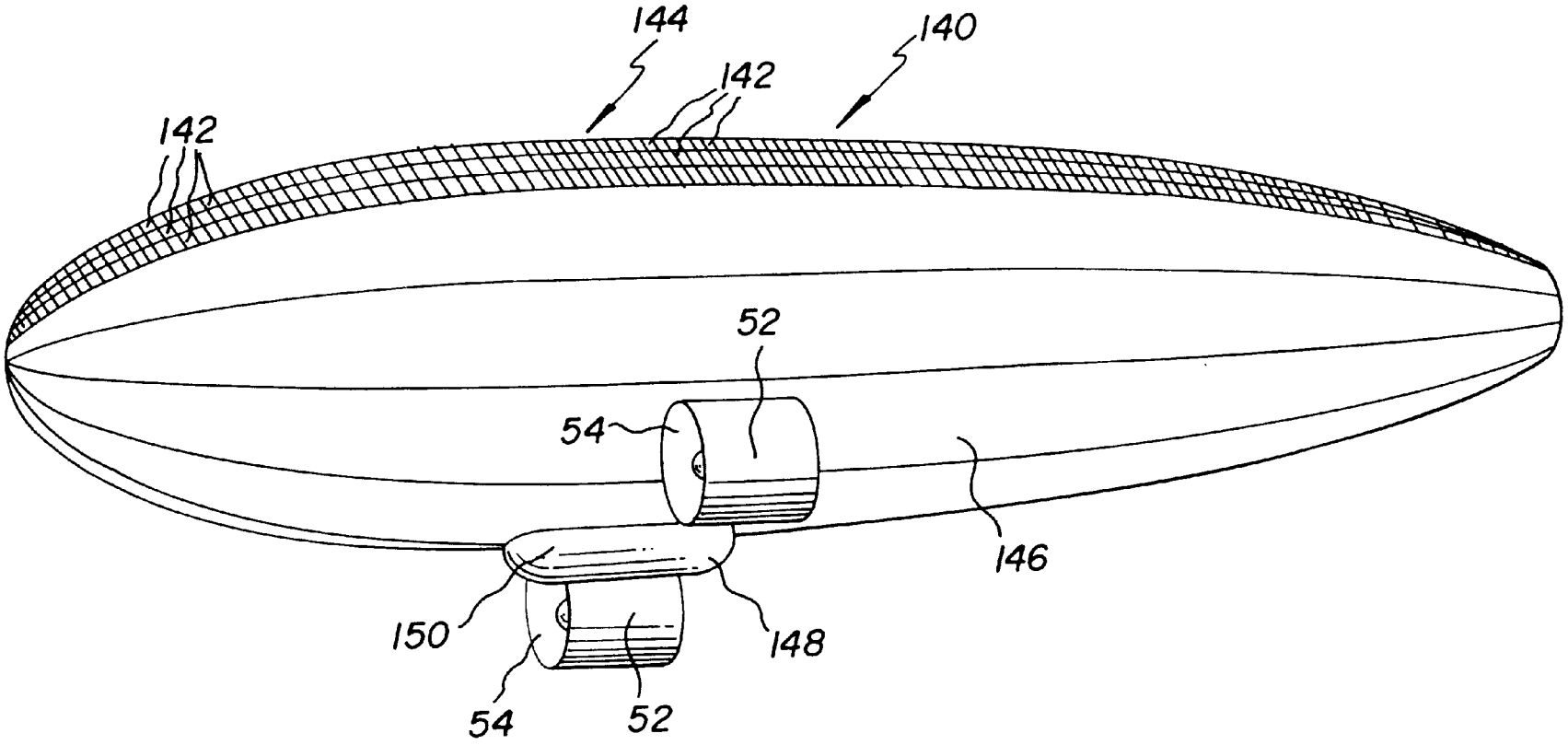
FIG. 19 is a perspective view of an airship utilizing ion engines constructed in accordance with the invention.
Figure 20:
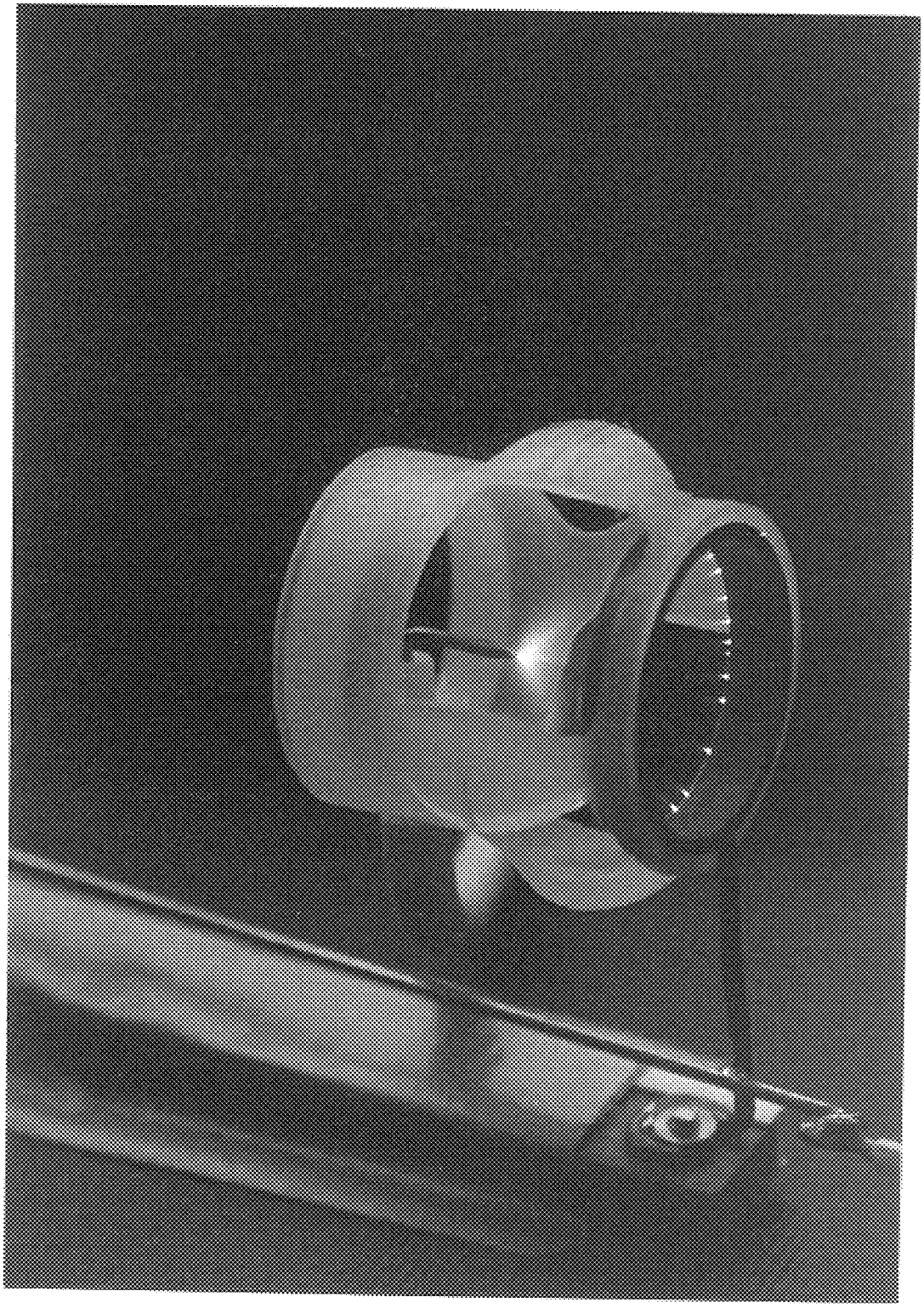
FIG. 20 (color picture no. 1) is a novel ion engine in operation illustrating the ionic discharge and the creation of negative ionic plasma.

Referring now to FIG. 19 an airship 140 for long term duration in the stratosphere is illustrated utilizing the novel ion engines. Airship 140 is designed to include for long duration in high altitudes in the upper stratosphere and includes a plurality of solar cells 142 on the upper surface 144 for providing a source of regenerative power. Lower surface 146 includes a storage battery compartment 148 which includes a plurality of storage batteries 150. Storage battery compartment 148 optionally may contain a guidance control system coupled to a remote control receiver 48 (FIG. 3) for controlling the operation of a pair of the novel ion engines 52 by a remote control transmitter 49.

The novel ion engine constructed in accordance with the invention is particularly adapted for disposition in the upper layers of the earth's atmosphere. The novel ion engine when constructed in accordance with the invention does not pollute the upper atmosphere because it produces ozone as a by-product of its propulsion and ionization of ambient atmospheric gas. As a result instead of polluting the atmosphere the novel ion engines constructed in accordance with the present invention operate to repair rather than destroy the earth's environment.

As heretofore discussed the novel ion engine and applications of the novel ion engine in ambient atmospheric gas may be modified in various ways by those skilled in the art. The cathodes and anodes may be constructed of various conductive materials by those skilled in the art and those skilled in the art may utilize various means for adjusting the distance between the cathode and anode to implement the invention in a variety of applications and embodiments. It will be appreciated that these and other modifications can be made within the scope of the invention as defined in the following claims.

What is claimed is:

1. An ion engine comprising:

(a) a highly tapered and polished cathode having the ability to generate at least one corona;

(b) an anode having a plurality of concentric rings of decreasing diameter in axial alignment with said highly tapered and polished cathode with the ring of the smallest diameter distanced furthest from said highly tapered and polished cathode;

(c) an electrically insulative housing for supporting said highly tapered and polished cathode and said anode; and (d) means for adjusting the distance between said highly tapered and polished cathode and said anode.

2. An ion engine comprising:

(a) a tapered cathode emitter terminating in a smooth pointed tip;

(b) an anode of a ring-shaped configuration;

(c) a housing composed of an electrical insulative material for maintaining said tapered cathode emitter in axial alignment with said anode;

(d) means for adjusting the axial distance between said tapered cathode emitter and said anode; and (e) means of providing a voltage differential between said tapered cathode emitter and said anode.

3. An atmospheric gas powered engine comprising:

(a) a housing composed of an electrical insulative material:

(b) a cathode of a substantially cylindrical configuration terminating in a tapered end;

(c) an anode of a ring-shaped configuration disposed in said housing in substantial axial alignment with said cathode; and (d) means for adjusting the axial distance between said anode and said cathode.

4. The atmospheric gas powered engine of claim 3 further comprising a nacelle composed of an insulative material.

5. The atmospheric gas powered engine of claim 3 further comprising an electrical power source for producing a voltage of from about −18 to −110 kv.

6. The atmospheric powered gas engine of claim 3 further comprising a pre-ionizer cathode for increasing the ionization rate of said ambient atmospheric gas before it arrives at said cathode.

7. The atmospheric gas powered engine of claim 3 wherein said cathode is composed of a conductive material.

8. The atmospheric gas powered engine of claim 7 wherein said tapered end of said cathode tapers to a polished needle shaped point.

9. The atmospheric gas powered engine of claim 8 wherein said cathode is constructed of brass.

10. The atmospheric gas powered engine of claim 9 wherein said cathode is constructed of aluminum.

11. The atmospheric gas powered engine of claim 3 wherein said anode is composed of a conductive material.

12. The atmospheric gas powered engine of claim 11 wherein said ring-shaped anode has a substantially rectangular cross-sectional configuration.

13. The atmospheric gas powered engine of claim 11 wherein said ring-shaped anode has a substantially circular cross-sectional configuration.

14. The atmospheric gas powered engine of claim 11 wherein said ring-shaped anode has an airfoil shaped cross-sectional configuration.

15. The atmospheric gas powered engine of claim 11 wherein said ring-shaped anode has a substantially oval cross-sectional configuration.

16. The atmospheric gas powered engine of claim 3 wherein said means for adjusting comprises an electromechanical motor in combination with a geared drive for precisely advancing and setting the axial distance between said anode and said cathode.

17. The atmospheric gas powered engine of claim 3 wherein said housing includes a separate bezel cathode supporting assembly composed of an electrical insulative plastic material.

18. The atmospheric gas powered engine of claim 3 wherein said housing is composed of an electrical insulative nylon material.

19. The atmospheric gas powered engine of claim 3 wherein said housing includes a substantially circular inlet opening and a substantially circular outlet opening interconnected by prong-shaped connectors.

20. The atmospheric powered gas engine of claim 19 wherein said substantially circular inlet opening includes means for slidably engaging said cathode.

21. The atmospheric gas powered engine of claim 3 wherein said ring-shaped anode includes a second ring circumscribed by the first ring of said ring-shaped anode.

22. The atmospheric gas powered engine of claim 3 wherein said ring-shaped anode includes a plurality of concentrically circumscribed rings.

23. The atmospheric gas powered engine of claim 22 wherein said plurality of concentrically circumscribed rings are axially displaced from said cathode based on ring size.

24. The atmospheric gas powered engine of claim 23 wherein said largest sized ring is disposed closest to said cathode.

25. The atmospheric gas powered engine of claim 3 wherein said housing includes a tapered configuration for increasing density of an ambient atmospheric gas before it arrives at said cathode.

26. The atmospheric gas powered engine of claim 25 wherein said means for increasing the density of said ambient atmospheric gas is a compressor.

27. The atmospheric gas powered engine of claim 25 wherein said means for increasing the density of said ambient atmospheric gas is a nacelle.

28. The atmospheric gas powered engine of claim 25 wherein said means for increasing the density of said ambient atmospheric gas is a second ion engine in axial alignment with the first ion engine.

29. The atmospheric gas powered engine of claim 6 wherein said pre-ionizer cathode is of a substantially cylindrical configuration terminating in a tapered end.

30. The atmospheric gas powered engine of claim 29 wherein said means for increasing ionization rate of said ambient atmospheric gas is a second ion engine in axial alignment with the first ion engine.

31. The atmospheric gas powered engine of claim 6 further comprising an electrical power source for providing about a −18 to −110 kilovoltage to said pre-ionizer cathode.

32. The atmospheric gas powered engine of claim 5 wherein said electrical power source is a rechargeable battery.

33. The atmospheric gas powered engine of claim 32 further comprising a renewable electrical power source.

34. The atmospheric gas powered engine of claim 33 wherein said renewable electrical power source is solar cells.

35. An ion engine for utilizing atmospheric gas as fuel comprising:

(a) a cathode of a substantially cylindrical configuration terminating in a tapered tip;

(b) an anode of a substantially circular configuration in axial alignment with said cathode;

(c) a housing constructed of an electrical insulative material having an opening at one end for adjustably engaging said cathode and means at the other end for engaging said anode; and (d) means for adjusting the axial distance between said cathode and said anode.

36. The ion engine of claim 35 further comprising an outer housing constructed of an electrical insulative material.

37. The ion engine of claim 35 wherein said cathode is composed of a conductive material.

38. The ion engine of claim 35 wherein said cathode is composed of brass.

39. The ion engine of claim 35 wherein said cathode is composed of aluminum.

40. The ion engine of claim 35 wherein said cathode is composed of magnesium.

41. The ion engine of claim 35 wherein said anode is composed of a conductive material.

42. The ion engine of claim 41 wherein said anode is composed of brass.

43. The ion engine of claim 41 wherein said anode is composed of aluminum.

44. The ion engine of claim 41 wherein said anode is composed of magnesium.

45. The ion engine of claim 35 wherein said anode includes a plurality of concentric circular rings in axial alignment.

46. The ion engine of claim 45 wherein said plurality of concentric circular rings are axially displaced with respect to each other.

47. The ion engine of claim 35 wherein said anode has a rounded leading edge and a tapered trailing edge.

48. The ion engine of claim 47 wherein said anode has a plurality of concentric circular rings having a rounded leading edge and a tapered trailing edge.

49. The ion engine of claim 35 wherein said means for adjusting the distance between said cathode and said anode is an electromechanical means.

50. The ion engine of claim 49 wherein said electromechanical means is an electric motor driving a gear.

51. The ion engine of claim 35 wherein said electrical insulative material is plastic.

52. The ion engine of claim 35 wherein said electrical insulative material is nylon.

53. An ion engine powered by atmospheric gas comprising:

(a) a cathode of a substantially cylindrical configuration terminating in a tapered tip;

(b) an anode of a substantially circular configuration in axial alignment with said cathode;

(c) an internal engine housing constructed of an electrical insulative material having mechanical means for adjusting the axial distance between said cathode and said anode;

(d) an external engine housing having an inlet opening larger than the outlet opening; and (e) electromechanical means in said internal engine housing for adjusting the axial distance between said cathode and said anode.

54. The atmospheric gas powered engine of claim 3 further comprising an outer housing.

55. The atmospheric gas powered engine of claim 54 wherein said outer housing has an inlet larger than the outlet.

56. The atmospheric gas powered engine of claim 5 wherein said electrical power source is controlled by a remote transmitter.

57. The atmospheric gas powered engine of claim 7 wherein said tapered end of said cathode tapers at an angle of 3 about 40 degrees or greater.

58. The atmospheric gas powered engine of claim 7 wherein said cathode is a hollow tube.

59. The atmospheric gas powered engine of claim 7 wherein said cathode is a solid rod.

60. The ion engine of claim 35 wherein said tapered tip tapers at an angle of about 40 degrees or greater.

61. The ion engine of claim 35 further comprising a pre-ionizer cathode for increasing the ionization rate.

62. The ion engine of claim 61 wherein said pre-ionizer cathode includes a step up transformer, a voltage multiplier and a ballast resistor.

63. The ion engine of claim 35 wherein said electrical insulative material is Delrin.

64. The ion engine of claim 36 wherein said outer housing has an inlet opening larger than the outlet opening.

65. The ion engine of claim 63 wherein said tapered tip tapers at an angle of about 40 degrees or greater.

66. The ion engine of claim 65 wherein said tapered tip tapers to a needle-shaped point.

67. The ion engine of claim 66 wherein said cathode and said anode are constructed of an electrically conductive material.

68. The ion engine of claim 67 wherein said cathode and said anode are constructed of brass.

69. The ion engine of claim 53 further comprising an electrical power source for producing a voltage of about −18 to −110 kv.

70. The ion engine of claim 69 wherein said cathode includes a step up transformer, a voltage multiplier and a ballast resistor.

71. The ion engine of claim 70 further comprising a pre-ionizer cathode for increasing the ionization rate.

72. The ion engine of claim 71 wherein said pre-ionizer cathode includes a step up transformer, a voltage multiplier and a ballast resistor.

* * * * *